United States Patent [19]

French

[11] Patent Number: 5,067,299

[45] Date of Patent: Nov. 26, 1991

[54] METHOD OF STACKING AND INSTALLING UNITIZED ROOFING SCHEMES

[76] Inventor: Christopher W. French, 27614 Renwick Ct., Saugus, Calif. 91350

[21] Appl. No.: 387,693

[22] Filed: Jul. 31, 1989

[51] Int. Cl.[5] ..... E04G 21/14; E04D 3/34

[52] U.S. Cl. ..... 52/745; 52/747

[58] Field of Search ..... 52/745, 749, 90, 92, 52/478, 283, 289, 702, 746–748; 29/462, 799; 108/55.3, 55.5; 414/788.2–789.2, 798.2, 798.4

[56] References Cited

U.S. PATENT DOCUMENTS

| | | | |
|---|---|---|---|
| 1,384,039 | 7/1921 | Blai | 52/92 |
| 2,295,248 | 9/1942 | Wittner | 52/578 |
| 2,472,843 | 6/1949 | Muise | 414/10 X |
| 2,570,234 | 10/1951 | Harris | 52/173 |
| 2,717,801 | 9/1955 | Neil | 414/10 X |
| 3,036,609 | 5/1962 | Quesenberry, Jr. | 269/910 X |
| 3,348,350 | 10/1967 | Mills | 52/90 X |
| 3,493,128 | 2/1970 | Silvert | 188/55.5 X |
| 3,500,597 | 3/1970 | McKenzie | 52/92 X |
| 3,601,882 | 8/1971 | McRäe | 29/432 X |
| 3,626,872 | 12/1971 | Cully | 108/55.5 X |
| 3,629,931 | 12/1971 | Stanley | 29/432 |
| 3,633,950 | 1/1972 | Gilb | 52/702 |
| 3,979,864 | 9/1976 | Tillié | 52/745 X |
| 4,796,350 | 1/1989 | French | 52/478 |

*Primary Examiner*—James L. Ridgill, Jr.

*Attorney, Agent, or Firm*—Frank L. Zugelter

[57] ABSTRACT

A method of stacking and installing prepared roofing schemes into a roofing context. A complete panel assembly is first prepared, thus "unitizing" it, after which a plurality thereof is stacked one on top of the next. The entire stack is raised to above the roof line of the context, then oriented in relationship thereto, and thereafter, settling the bottom unitized roofing scheme in the stack into place in the roofing context and fastening it thereto. The stack of remaining schemes is removed from the fastened installed scheme, the now lowest one placed into its proper position in the roofing context, settled, and fastened. This procedure is repeated as often as necessary, always settling the lowest remaining scheme in the stack first to the roofing context after the stack has been removed from the immediately previously installed scheme.

19 Claims, 6 Drawing Sheets

35
34
34
37
41
41
41
36
40
38
39
39
39
39
31
31
31
31
33
33
33
33
33
33
33
33
32
32
32
32
32
48
48
48
48
30

37
36
30
31
31
31
31
32
42
58
58
68
69
74
62
54
30
73
62
67
67

31a
31b
31c
31d
32
33
43
48
50
51
52
53
54
55
56
73
74
99

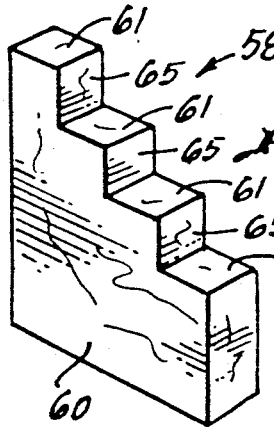
FIG. 7.
FIG. 8.
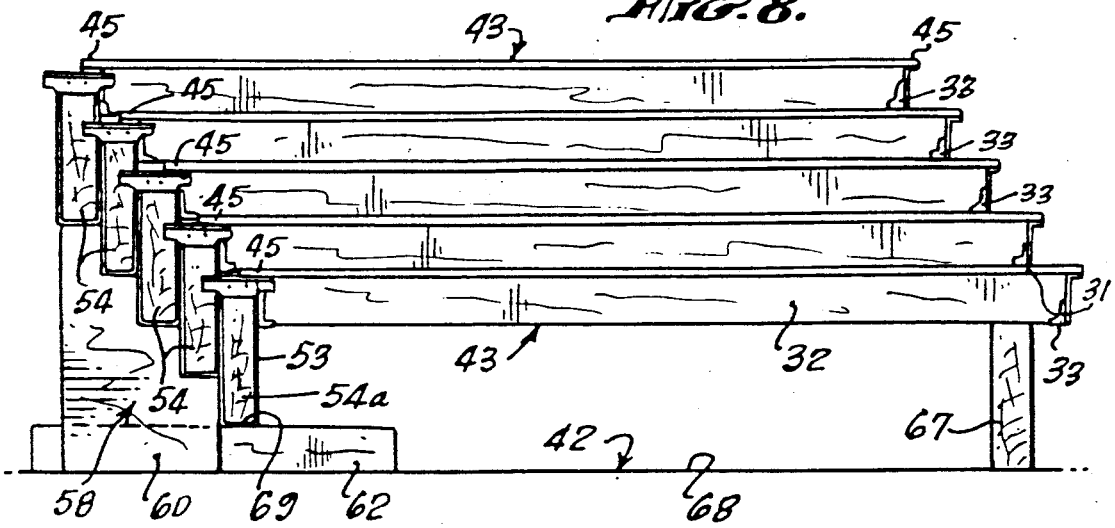
FIG. 9.
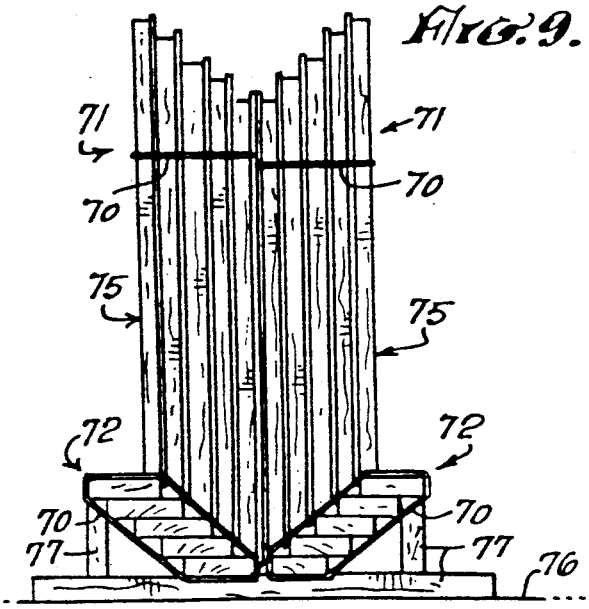
FIG. 10.
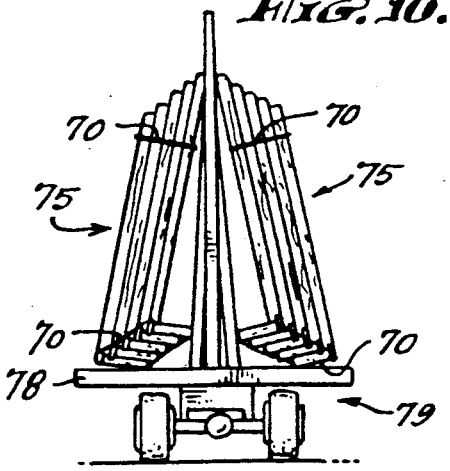

FIG. 16.
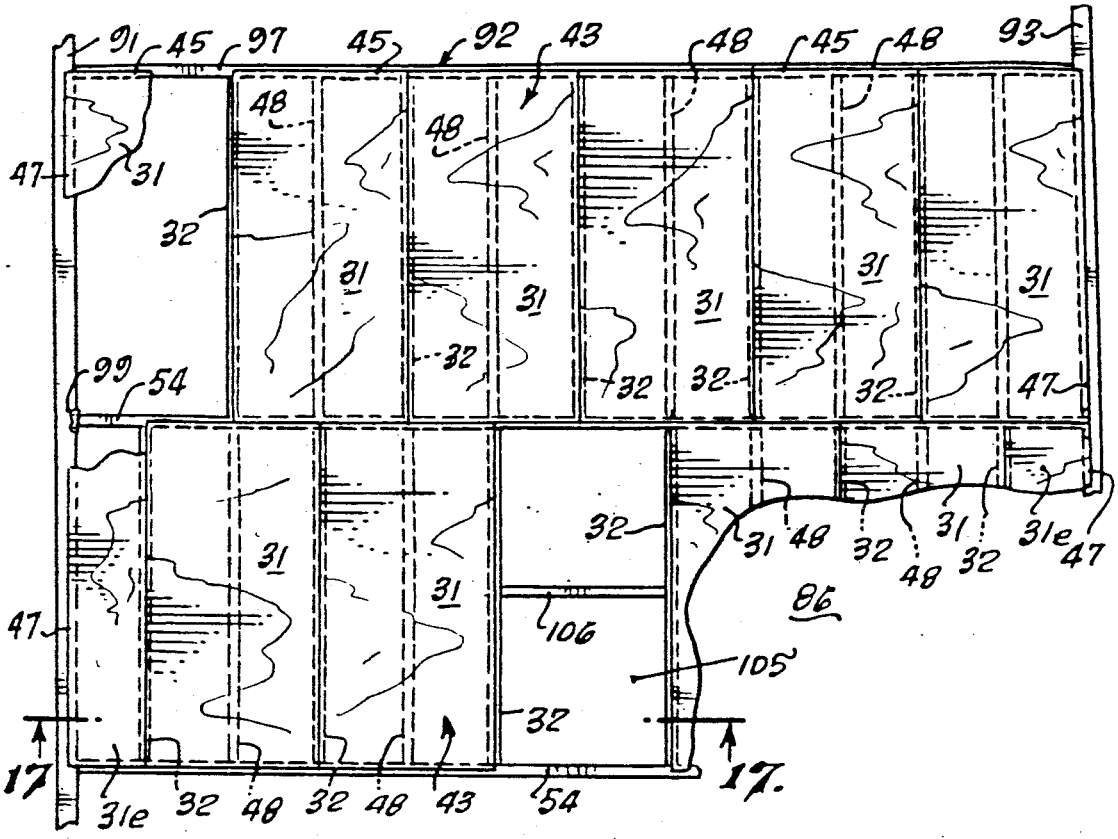
FIG. 17.
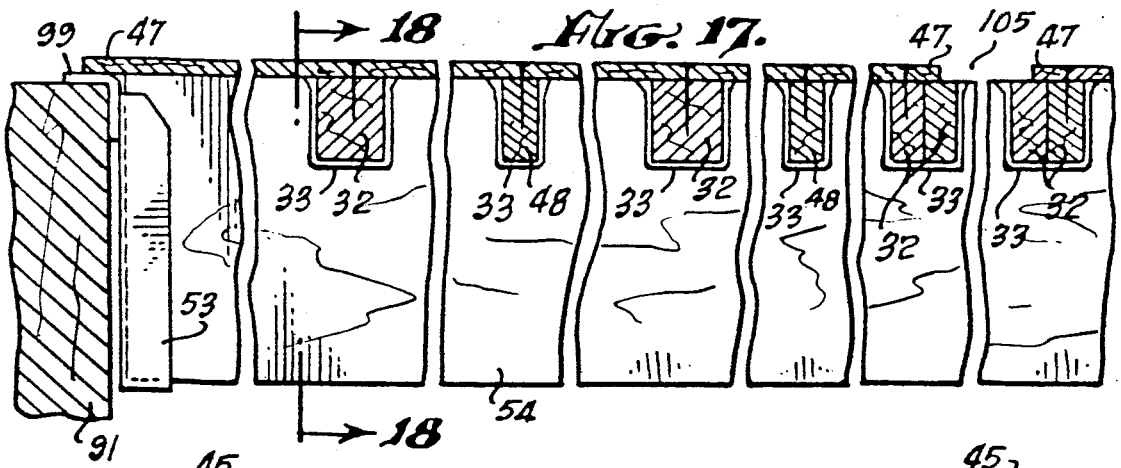
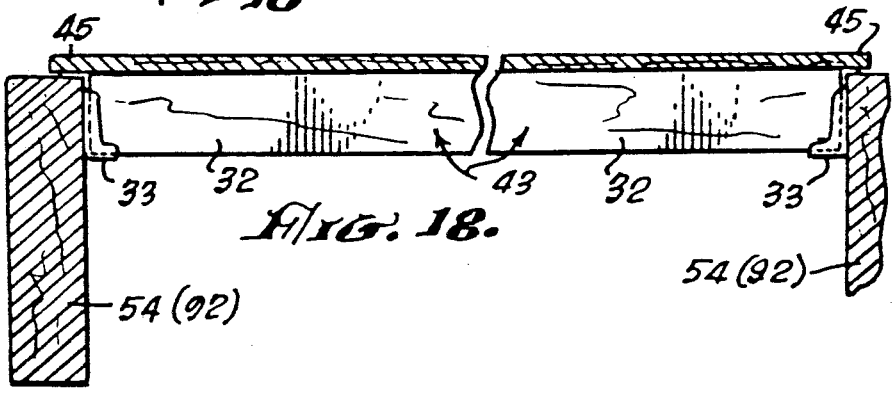
FIG. 18.

METHOD OF STACKING AND INSTALLING UNITIZED ROOFING SCHEMES

TECHNICAL FIELD

This invention relates to stacking and installing assembled roofing panels fastened to their beams, and in particular, to a method of stacking together a plurality of panel assemblies with beams, and installing each of such stacked assemblies as it is removed from its stacked mode.

BACKGROUND ART

My U.S. Pat. No. 4,796,350, granted Jan. 10, 1988, discloses apparatus and method of assembling and unitizing a roofing panel, however, it falls short of this inventive concept. The prior art teachings of record in the noted Letters Patent may be useful to the understanding, searching and examining of the application for patent on this invention.

DISCLOSURE OF THE INVENTION

The invention comprises the steps of stacking a plurality of unitized roofing schemes and thereafter installing each of them in a sequential fashion from the stack in a roofing context. In particular, upon a panel assembly being assembled, it then is fastened to a purlin to form a unitized roofing scheme. Each scheme then is stacked one to the next, using stacking means which provide positioning of one scheme to the next as they are stacked to one another and that is required to maintain them in a stacked mode. Any number of stacked schemes may be developed or desired. The stack then is bound, primarily because of it being transported from the factory to the construction site. However, were the stacked mode generated or achieved at site, binding may not be required or needed. At site, the stack is raised to above roof line by means of a forklift or other suitable equipment or machine, and then oriented to the roofing context, such as a bay or section in which each is to be installed. Thereafter, the forklift is manuevered to settle the lowest scheme in the stack into place in the bay or section, after which it is fastened to the beams forming the bay. The remaining schemes in the stack then are removed therefrom by the forklift which then is manuevered again to settle the now lowest scheme in the stack into its place or position in the bay or section, usually adjacent to the immediately previously installed scheme and fastened in place. And so on, until all schemes in the stack have been installed.

An object of the invention is to provide a novel method of stacking and installing unitized roofing schemes.

Another object of the invention is to provide a unique and novel method of installing unitized roofing schemes.

A further object of this invention is to reduce labor costs in the building of roofing constructions.

Another object of the invention is to provide a more efficient manner of applying more than one unitized roofing scheme to its installed position at the roofing line of a bay or section of a building under construction.

A still further object of the invention is to provide accuracy in installation of a plurality of roofing schemes and by which further carpentry work on installed schemes, required or needed upon inspection, is eliminated, again reducing time and labor costs of construction.

These and other objects and advantages will become more apparent upon a full and complete reading of the following description, the appended claims thereto, and the accompanying drawing comprising six (6) sheets and 18 FIGS.

BRIEF DESCRIPTION OF THE DRAWING

FIG. 7 is a perspective view of a block, ladder or stacking means utilized at a location or station for unitizing and stacking roofing schemes one to the next.

FIG. 8 is an elevational view of such location, with a plurality of such schemes shown stacked one to the next and in an unbound mode.

FIG. 9 is an elevational view of a plurality of bound stacked schemes each of such bound schemes turned ninety (90°) degrees from its stacked position illustrated in FIG. 8.

FIG. 10 is a schematic view of a plurality of bound stacked unitized roofing schemes mounted on a bed of a mobile vehicle for transporting them to a construction site at which such schemes are to be installed.

FIG. 16 is a plan view enlarging FIG. 11, and turned 90° in the drawing sheet from FIG. 11, of a plurality of unitized roofing schemes installed in a bay or section of roofing under construction.

FIG. 17 is a view taken on line 17—17 of FIG. 16.

FIG. 18 is a view taken on line 18—18 of FIG. 17.

BEST MODE (S) FOR CARRYING OUT THE INVENTION

Figure 1:
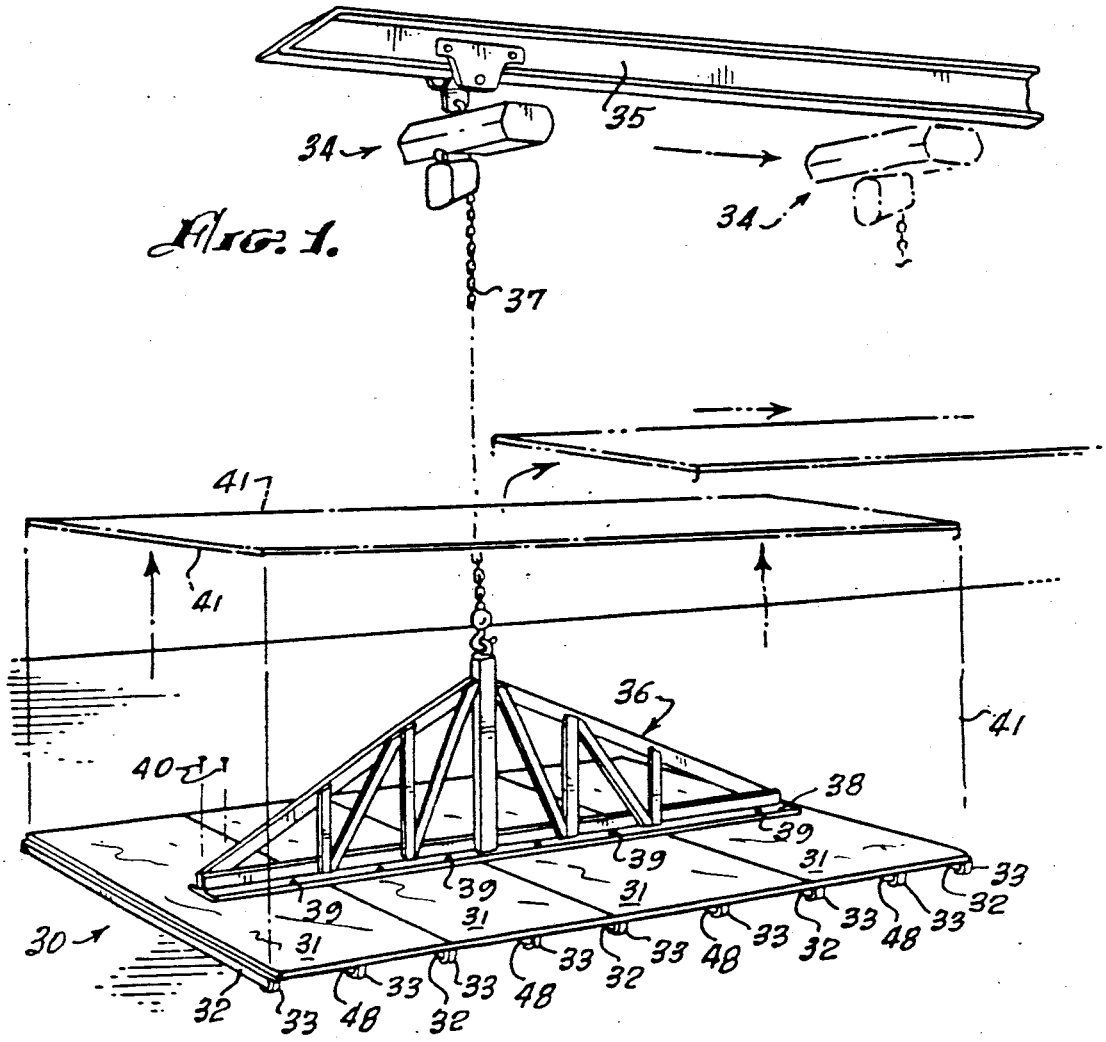
FIG. 1 is a perspective view of assembled panels being lifted for movement to another location for further assembling and unitizing.

Referring now to the drawing wherein reference characters therein correspond to like numerals hereinafter, 30 in FIG. 1 represents an assembly of a plurality of wooden panels 31 (say, 4' by 8'), studs, rafters, or sub-purlins 32, and their hangers 33. Assembly 30 is being lifted up by a conventional movable hoisting apparatus 34 rollably mounted on an I-beam 35 such as found in a factory or warehouse facility. A carrier 36 is hooked to chain 37 of the hoist 34 and includes an elongated preferably flat plate 38 having spaced holes 39 therein for passage of nails 40 therethrough. The length of assembly 30 is being temporarily secured by such nails 40 through holes 39 to plate 38, preferably as shown, in order to transport assembly 30 from an initial station 41, FIG. 1, at which assembly 30 has been completed, to a location or station 42, FIG. 2, for unitizing the assembly into a roofing scheme 43, FIG. 6, and thereafter stacking and binding together a plurality of unitized roofing schemes, of which assembly 30 is part of each one, prior to installing the schemes at a construction site.

Figures 3, 4, 5, 6:
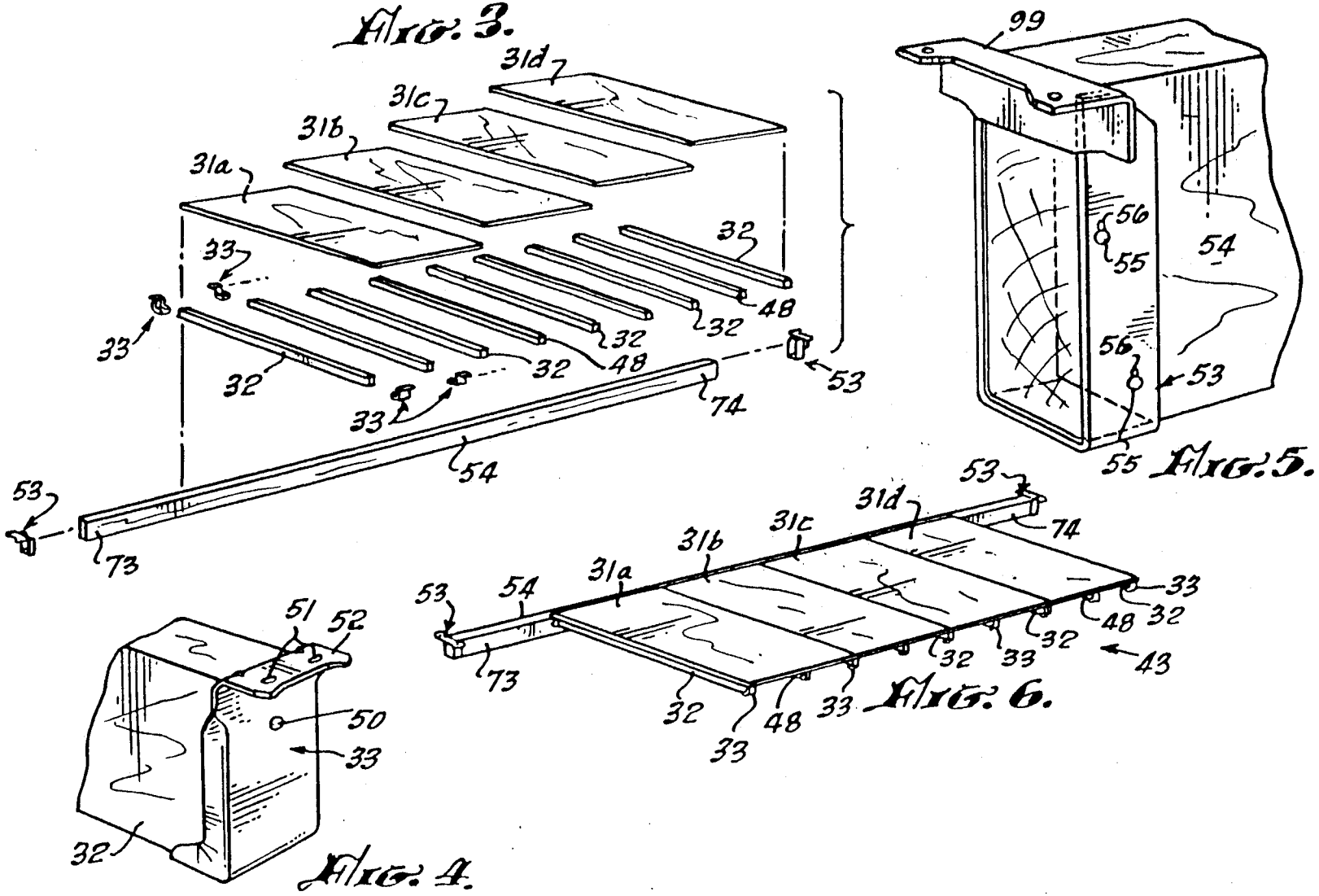
FIG. 3 is an exploded perspective view of unassembled panels, a major or purlin beam, and a plurality of rafters, studs or sub-purlins, and hangers, in a general relation to one another.
FIGS. 4 and 5 are perspective views of the ends of a rafter and a beam, respectively, and on which metal hangers are correspondingly mounted.
FIG. 6 is a perspective view of a unitized roofing scheme comprising the elements illustrated in FIG. 3.

The panel assembly 30 is completed in carpentry fashion and/or with the use of a conventional jig (not shown) which joins together in sheet-like fashion a plurality of panels 31*a*, 31*b*, 31*c*, 31*d*, to corresponding ones of a plurality of sub-purlins, studs, or rafters 32, FIG. 3. The length of each sub-purlin 32 is not as long as the length of the panels 31 to which they are fastened such as by nails (not shown), this being clearly illustrated in FIGS. 8, 13, 14, 15. Overlapping edge portion 45 on the assembled panels results at both ends of the sub-purlins 32, FIG. 8. Further, as will be seen in FIG. 16, in the fabrication of assembly 30, overlapping edges 47 result along the 8' lengths of the two end panels 31 which themselves terminate the length of assembly 30. These overlapping portions and edges, practically speaking, have one-half (½) the dimension of the thickness of the member or members to which the assembly 30 is to be fastened, as more fully described hereinafter. Additional fastened sub-purlins 48, i.e., every other one to be found in an assembly 30 that is not related to such portions or edges as are sub-purlins 32, but included in accordance with construction specifications or applicable building codes, likewise fall short of being flush with the 4' edges of each of the panels 31 to which they are correspondingly fastened by nails.

Conventional metal hangers 33 are securely mounted such as by nails 50, FIG. 4, to both ends of each sub-purlin 32, 48, and so done preferably during the assembling or fabricating of panels 31 at station 41. Holes 51 in an upper flange 52 of each hanger 33 are provided for the introduction of nails (not shown) to secure hanger and sub-purlin to panel.

Conventional metal hangers 53, FIG. 5, are securely mounted to the ends of a major beam or purlin 54 by nails 55 through holes 56. Such mounting or nailing is accomplished, generally speaking, at a time when purlin 54 is first positioned in or at station 42.

Each panel assembly 30 is to be securely mounted to a purlin 54, and thereby form a single unitized roofing scheme 43, FIGS. 6, 8, 13, 14, 15. The securement of hangers 53 to the ends of their purlins 54 preferably is performed at station 42, FIGS. 2, 8, while awaiting a panel assembly 30 from station 41. It may be noted that securement of either hangers 53 to their purlins 54 or hangers 33 to their sub-purlins 32 or studs 48 may be accomplished at stations or locations other than stations 41, 42, although it now should be apparent that such securement is most efficiently accomplished at stations 41, 42.

A unitized roofing scheme 43 is illustrated in FIG. 6, and constitutes a basic fabricated unit which is to be stacked to like or similar units at station 42, thereafter bound and thence transported to their construction site. To form a unitized roofing scheme 43, hoist 34 carrying the assembly 30 moves such assembly 30 to overhead of station 42 at which a plurality of them are to be stacked after unitizing each one of them.

Prior to lowering to station 42 a carrier 36 with its lifted assembly 30 attached thereto, means 58, FIG. 7, for stacking a plurality of unitized roofing schemes 43 is positioned at or in station 42. It is to be noted that the unitizing of these schemes is accomplished with use of stacking means 58 during the process of achieving such stacking result, so that upon completion of such unitization the schemes are mounted in a stacked mode on the stacking means 58. However, such unitization may be accomplished at a station other than the stacking station 42 and thereafter stacked one scheme upon the next.

As shown in FIG. 7, each stacking means 58 comprises a configured wooden block 60 in which a series of steps 61 are formed one over the other and rearwardly of one another as they ascend in their positions in block 60 in a manner similar to staircases. Two (2) means 58 are used, FIG. 2, in operation of the invention. An additional pair of support members 62 (one of them shown in FIG. 8) may be used where the lowest step 63 in block 60 is higher from the block's bottom than the risers 65 are between each of the steps 61 in block 60. FIG. 8 illustrates this effect, and an advantage accrues in such operation when this is the case, as the work required to produce the first or lowest scheme in the stack being generated need not be compounded by the configurations of blocks 60 in its fashioning and stacking at station 42. In other words, after the lowest scheme 43 has been fashioned at station 42 on support members 62, it is easier to set blocks 60 against a purlin 54*a*, the lowest one, as illustrated in FIG. 8, than to try to physically relate purlin 54*a* to a first or lowest step 63 of each of the blocks 60.

Figure 2:
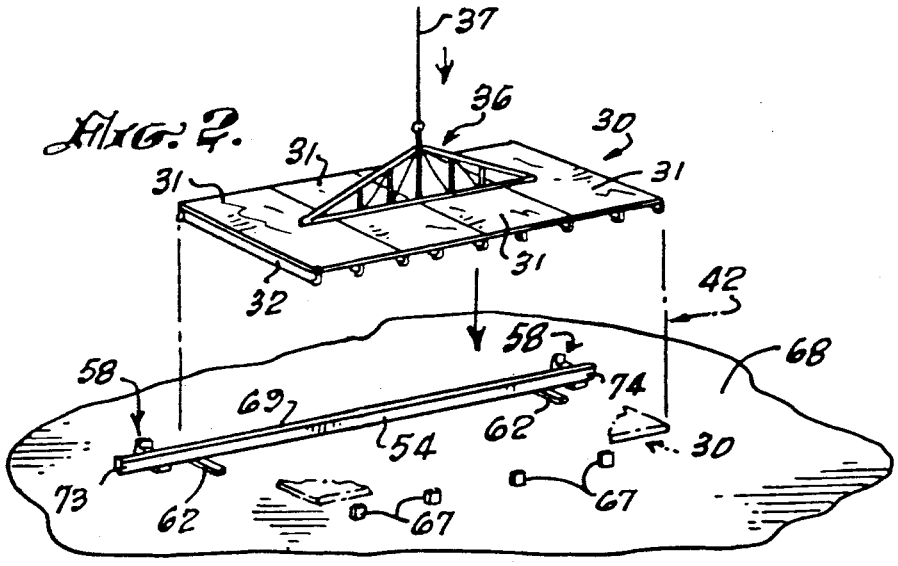
FIG. 2 is a perspective view of such assembled panels at such location for further assembling and unitizing.

One or more secondary support members 67, FIG. 2, 8, facillitate the unitizing and stacking processes carried out by laboring personnel at station 42. Members 67 are spacedly seated from one another, FIG. 2, on floor 68 of station 42 and at a distance from blocks 60 or means 58 and support members 62, for levelling the lowest panel assembly 30 shown. Members 67 are seated in FIG. 8 in areas distal from the purlin 54 to which the lowest panel assembly 30 is to be joined or fastened. Each member 67 directly supports or engages a sub-purlin in order to support such lowest panel assembly 30, FIG. 2. Thus, the joining of the overlapping edge portion 45 of each panel assembly 30, at stacking station 42, to the edge or thickness dimension 69, FIG. 2, of its corresponding purlin 54 will be square in fit as it is intended to be. The overlap portion 45 is nailed in conventional fashion to one-half (½) of the purlin's edge 69, FIG. 8, so that the result is a unitized roofing scheme 43, FIG. 6, 8, disposed in a position in station 42 for stacking it with others.

As the first panel assembly 30 is lowered, FIG. 2, onto a purlin 54 seated or related to stacking means 58, FIGS. 2, 8, overlapping portion 45 on the assembly 30 is mounted to one-half (½) of the edge 69 on such corresponding purlin 54 the bottom edge 69 of which has been seated on the lowest ones of the steps 61 (63) against their corresponding risers 65 of the pair of spaced blocks 60. Hangers 33, i.e., their flanges 52, mount on the upper edge 69 of such purlin 54 while overlapping portion 45 then is nailed to the same purlin 54. After completion of such lowest unitized roofing scheme 43 while mounted on blocks 60, the scheme is also in position for stacking additional schemes on it. A second purlin 54 is mounted and seated on the next higher pair of steps 61 of spaced blocks 60 and against their corresponding risers 65, after which a second panel assembly 30 from station 41 (or elsewhere) is lowered into station 42 and mounted to the second (next higher) purlin 54 in the same manner as was carried out and as described above with respect to the first panel assembly and its corresponding purlin. Again, the hangers 33 mount to the upper edge 69 of the purlin while overlapping portion 45 of such second panel assembly is nailed to one-half (½) the dimension of upper edge 69 of its corresponding purlin. A second unitized roofing scheme 42 now is complete and is stacked upon a first such scheme. These steps of unitizing and stacking of such schemes continues until a desired number of schemes are stacked on stacking means 58, an illustration of which being FIG. 8, such number being limited by the number of steps in blocks 60 and perhaps equipment not strong enough to be able to lift, hold and transport the number of stacked schemes sought to be moved.

With stacking completed, FIG. 8, a plurality of binders 70, in the form of flexible steel strips, are utilized to secure together each stack of schemes 43. A binder 70 is wrapped around the stacked panel assemblies 30, at positions 71, FIG. 9, and at positions 72, FIG. 9, around the terminating ends 73, 74, FIG. 3, of stacked purlins 54, where no panel assemblies obstruct such wrapping. Known equipment is used to secure such binders to themselves about the stack of schemes. Each bound stack 75 of schemes, FIG. 9, then is transferred or transported, say, by forklift equipment, to a waiting or storage station 76, FIG. 9, at which they are turned upwardly at 90° as shown, and supported in a new vertical orientation by suitably dimensioned wooden supports 77. Thereafter, each bound stack 75 is loaded, FIG. 10, upon the bed 78 of a mobile tractor 79 and made secure thereon in appropiate fashion for transporting it to the construction site at which each scheme 43 thereof is to be installed.

The width or depth of each step 61 is equated to the thickness 69 of the edges of purlins 54, FIG. 8. With the assistance of supports 67, this assures a square fit, so to speak, for stack 75 in its generation by the mounting of the schemes herein described. In addition, each purlin supports its immediately adjacent purlin in the scheme next to it, each purlin being partially ascended or descended to its neighbor purlin, to thereby prevent lateral shifting of the one position of one scheme from the next in their stacked mode. FIGS. 9 and 10 illustrate that such shifting does not occur. As a stack has been processed or moved out of station 42 to either station 76 or onto bed 78 of tractor 79, the purlins 54 are retained together, physically engaging one another in sequential fashion, while the stacked mode of schemes is forklifted from one point to another. This is achieved by maintaining the purlins in their stack in the lowest possible position during and after removal of such stack from station 42, to either station 76 or on to bed 78. With the assistance of a forklift and work personnel, this is readily accomplished.

FIGS. 11–18 illustrate the steps for installing one or more unitized roofing schemes 43 in a roof bay or section at a construction site. At the construction site, each bound stack 75 is removed from bed 78 of tractor 79 and is positioned as in FIG. 11 upon the forks 80, FIGS. 11, 12 of an adjustable mechanism 81 mounted on a telescopic boom 82 of a forklift mobile machine 83, such positioning obtained by the manuevering of machine 83 and its described components upon the bound stack. Each bound stack 75 may, of course, be stored at the construction site for later use, prior to being mounted to forks 80. Each bound stack 75 becomes an unbound stack 84, FIG. 11, before or after positioning it on forks 80, as desired, or even after the stack has been raised above the roof line or beams 91, 93, by snipping off with pliers binders 70. Mobile forklift machine 83 and its forks 80 carry or transport a now un-bound stack 84 to an area immediately within a construction bay or section 86, FIG. 11, at which installation is to occur. Machine 83 approaches section 86 with its load 84, and is set, as in FIG. 11, in a stationary mode in which boom 82 raises load 84, to above the roof line, FIG. 12. Machine 83 then is manuevered ninety (90°) degrees in turn, from the direction of its approach shown in FIG. 11 to that shown in FIG. 12, so that the stack 84 of schemes is properly oriented for disposition in bay or section 86 in which installation of such carried schemes is to be undertaken.

Figure 11:
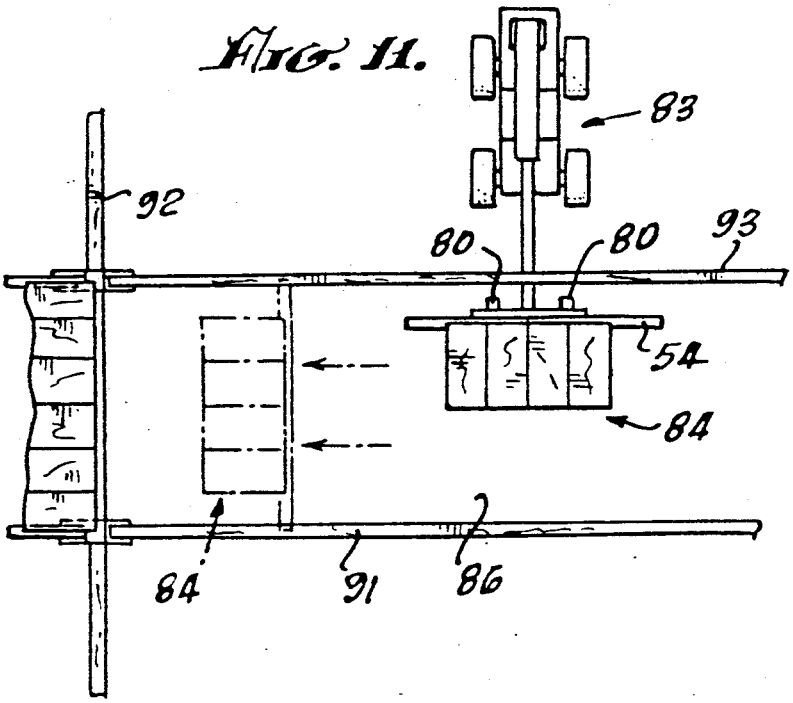
FIG. 11 is a schematic view of an operation of transporting one stacked now-unbound plurality of schemes to an existing roofing bay or section in which each of such schemes is to be installed, one to the next.
Figure 12:
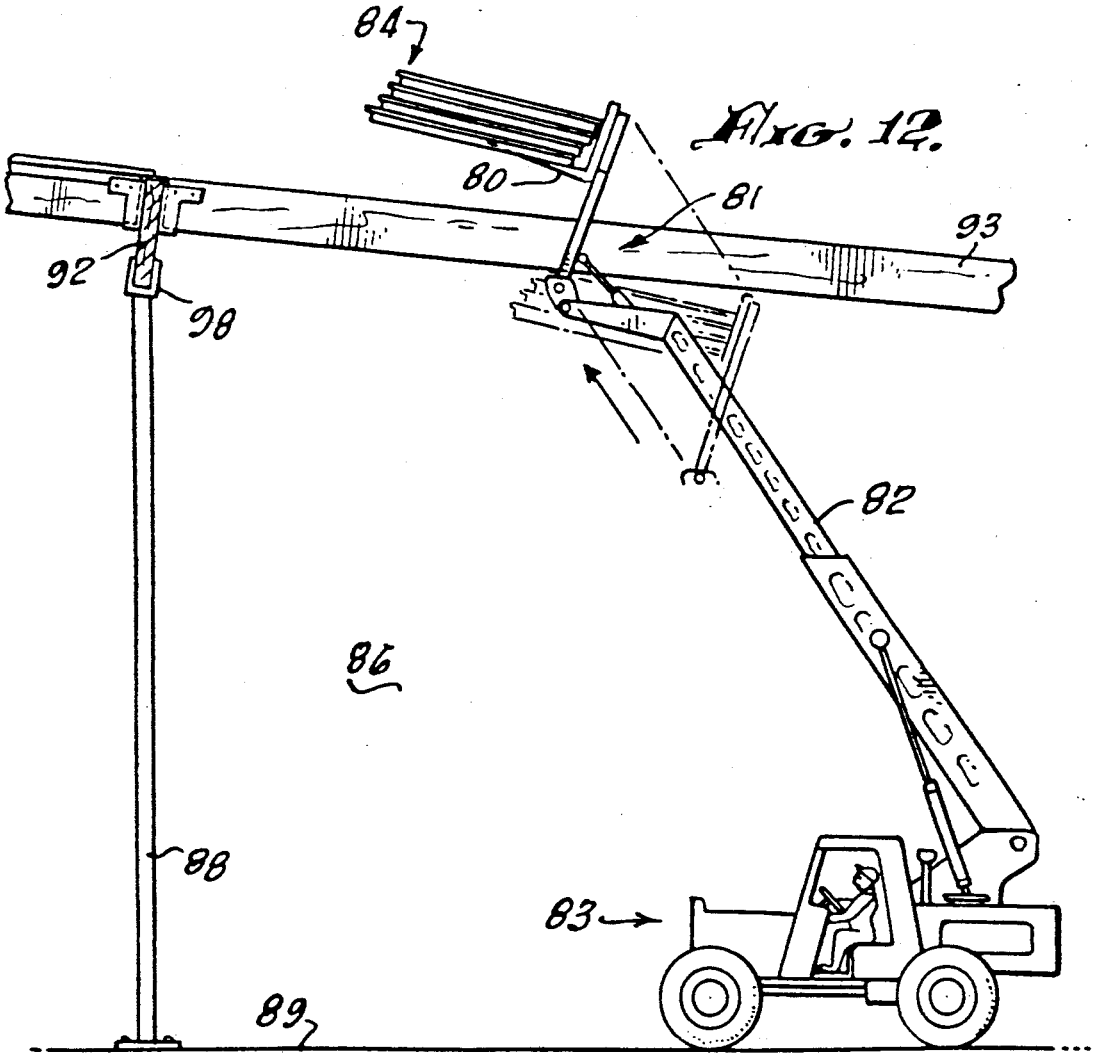
FIG. 12 is an elevational view illustrating the raising of a stack of unbound schemes into a preliminary position relative to the roofing section or bay, immediately preparatory to removing each of such schemes from their stacked mode for installation on or in the roofing section or bay.
Figure 13:
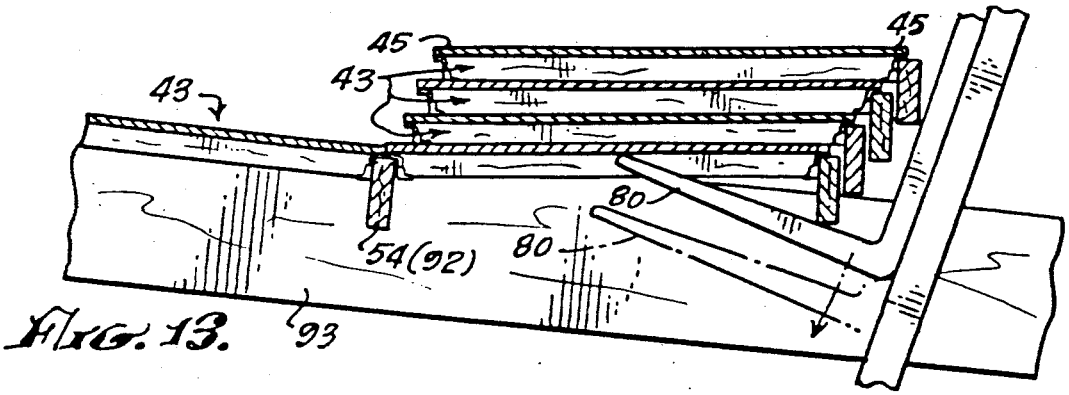
FIG. 13 is an enlarged fragmentary elevational view of one of the stacked schemes unbound being installed in proper position in the roofing bay or section.

The structural context of a bay or section 86, FIGS. 11, 16, is such as to receive the unbound stack for proper disposition and installation of its schemes therein. In the illustrations of FIGS. 12–18, such context comprises at least four (4) vertically-oriented spaced steel posts 88 securely mounted to their concrete slab 89. Although FIG. 12 shows but one such post 88, it is to be understood that four (4) such posts are mounted on slab 89 and vertically oriented in rectangular or box-like configuration for supporting in conventional manner laminated beams 91, 92, 93, FIGS. 11, 16, and a fourth one (not shown) to which the direction of installation advances (from beam 92).

With the proper orientation of each stack 84 of schemes within bay or section 86, FIG. 12, and above the roof line for the laminated beams, machine 83 advances so that the overlapping portion 45 FIG. 16, of the lowest scheme 43 in the stack which engages forks 80, is lowered by operation of forks 80, and their telescopic boom 82, with movement of machine 83 when necessary, to mount upon one-half (½) of the upper edge 97, FIG. 16, of laminated beam 92 that is mounted to steel posts 88 via metal U-shaped supports 98, FIG. 12. As such lowest scheme 43 begins to settle into position within bay or section 86 the flanges 52 on hangers 33 on subpurlins 32 and the flanges 99, FIG. 5, on hangers 53 on the ends of the purlins 54 bear respectively against some of the thicknesses of laminated beams 92 and 91, 93. Such settling occurs as forks 80 are withdrawn or lowered from under such lowest scheme 43, this being shown in phantom in FIG. 13. A roof worker (not shown) nails or fastens down the overlapping portion 45 to laminated beam 92 (beam 92 shown in FIGS. 11, 12, 16, and its equivalency is shown as purlin 54 in FIG. 13) and the similar overlapping edges 47 bearing on one-half (½) the thickness of their corresponding laminated beams 91, 93 which they physically engage. The lowest scheme 43 in stack 84 now is installed and the next lowest scheme is now the lowest in the stack which is continuing to rest on the installed scheme. Once again, forks 80 are advanced, FIG. 14, so that their tips 102, shown in phantom in FIG. 14, grasp only the bottom (thickness 69) of the purlin 54 of the now lowest scheme 43 of the stack, and elevates or pivots upwardly, by their operation, the stack of remaining schemes in order that a wooden support bar 103 can be insertedly mounted on the top of the panel 31 of the already installed scheme 43, such insertion then providing advancement of forks 80 to underneath the remaining schemes in the stack. Now, forks 80 are advanced under the stack of remaining schemes, as illustrated in phantom at 104 in FIG. 14 and as shown in solid lines in FIG. 13, in order to raise the remaining stack completely free of the installed scheme.

Figure 14:
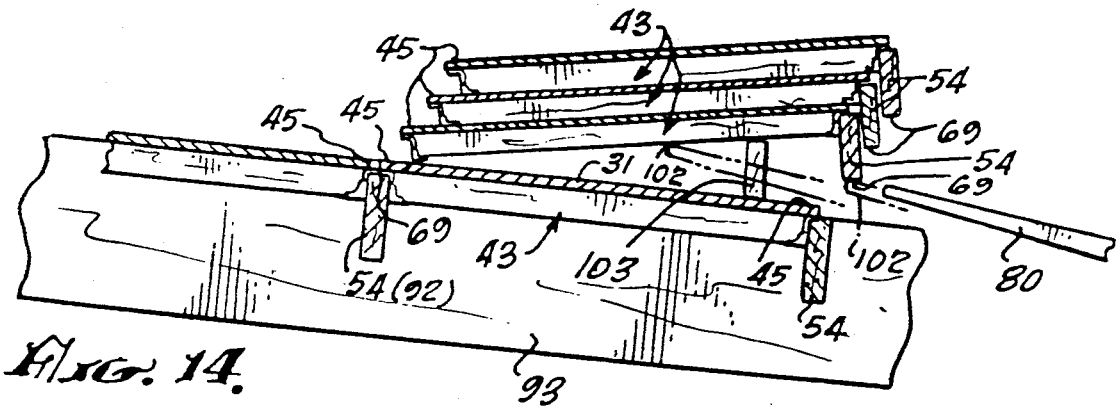
FIG. 14 is an enlarged fragmentary elevational view of a detailed step of installing each scheme by its removal from its stacked mode into its proper position in the roofing bay or section.
Figure 15:
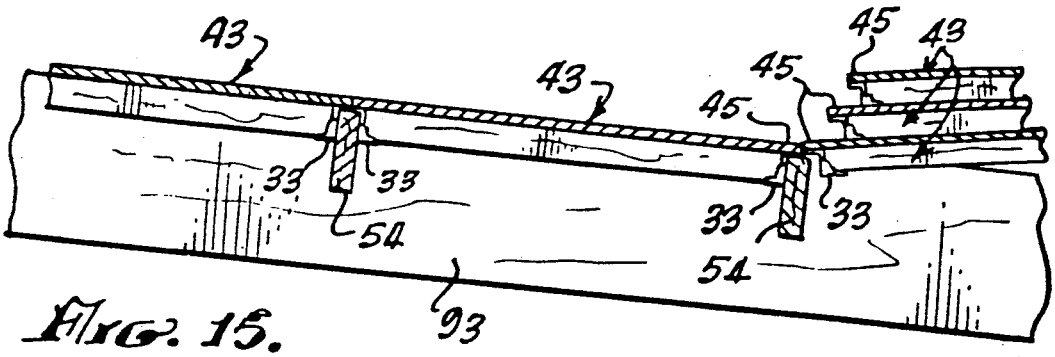
FIG. 15 is an enlarged fragmentary view showing the completion of the FIG. 14 installation while initiating another such installation with the next stacked scheme.

Machine 79 is moved or driven rearwardly, carrying the remaining stacked schemes, to a point where once again, it can advance, FIG. 15, to mount overlapping portion 45 of the next lowest stacked scheme 43 to the edge 69, FIG. 14, of purlin 54 of the previously installed scheme 43, which purlin 54 is in proper and secured position in its roofing bay or section. Again the above described procedure is repeated in this instance, and in each instance of a scheme 43 that has become the lowest scheme in the stack by operation of this method of installation, and as illustrated in FIG. 15.

FIGS. 16 and 17 illustrate that the method encompasses roofing construction in which openings for various reasons, such as for providing space for subsequently installed ventilating and/or heating equipment, are desired. In the construction of an assembly 30 of panels, one or more openings are provided by simply not fastening a panel 31 in place across a particular span between spaced but immediately adjacent subpurlins 32. For example, in FIG. 16, opening 105 is provided by the omission of a panel 31 not being mounted therein, while a temporary wooden brace 106 is nailed in the opening across such opening and to the subpurlins 32. It is removed after the scheme 43 has been installed in a bay or section of the roofing under construction. FIG. 16 also illustrates the advantage of off-setting the panel assembly in one scheme in place in the roofing to that in another scheme also in place in the roofing area, between major beams 91, 93, which off-setting sometimes is desirable in constructions. In these situations, two ½-sized panels 31*e* are added manually after their corresponding or particular schemes 43 have been installed. FIG. 17 also illustrates the various sized subpurlins 32, 48 that can be utilized with this method, in terms of their widths and which are called for in the construction plans for a given roof, although not necessarily limited to those illustrated. FIG. 18 illustrates the tightness and accuracy of fitting subpurlins 32, 48 and panels 31 to laminated beams or purlins in the operation of the invention, all of which contributes to accurate centering and installing of a plurality of roof schemes and their panels along the entire length of each bay or section in which the panels on their purlins and subpurlins are being mounted and secured.

The use of the method will be readily apparent from a consideration of the foregoing. However, briefly, a panel assembly 30 is first assembled at station 41 in any suitable fashion, after which nails 40 temporarily attach carrier 36 to it. Hoist 34 by its chain 37 lifts each panel assembly 30 from station 41 and conveys it via its rolling along overhead I-beam 35 to station 42. Prior to lowering panel 30 to station 42, stacking means 58 along with support members 62 are positioned thereat, and a purlin 54 is seated on support members 62 and against the front edges of stacking means 58. With assistance of working personnel, panel 30 is lowered into a proper relationship to seated purlin 54, its overlapping portion 45 being mounted to and engaging upper edge 69 of purlin 54, while members 67, already having been distributed about at station 42, are placed under subpurlins 32. Portion 45 is nailed to the upper edge 69 of purlin 54. The same procedure to station 42 from station 41 again is used with respect to a second panel assembly 30, however, this time the bottom edge 69 of a pre-positioned second purlin on stacking means 58 seats on steps 63 thereof, between the corresponding risers 65 and the one side of the first purlin previously related to stacking means 58. The second panel assembly 30 is fastened to the second purlin in the same way as was done with the first panel assembly to its purlin, the second purlin having been seated on the second steps 61 of stacking means 58. And so on, until the desired number of schemes have been incorporated into a stack thereof. Binders 70 are applied, and the stack is moved to storage or to station 76 from which it is taken to the construction site via tractor 79. In use at the construction site, forklift machine 83 carries the stack to the bay or section at which each of its schemes is to be installed. Machine 83 is manuevered to orient the stack in a proper relationship to the bay or section, and then raises it above the roof line, and thereafter installs each scheme (now unbound from the others) in the stack. In doing so, the scheme lowest in the stack is settled into place by manuevering the forklift, such that its overlapping portion 45 engages the upper edge of beam 92 (or another purlin 54 already in place) while edges 47 engage the upper edges of the beams 91, 93. The tips of the forklifts 80 then are brought to bear against the bottom of the purlin 54 of the now (next) lowest scheme in the stack, and elevates it (tips it up) in order to place wooden bar 103 under its panels 31, thereby maintaining a sufficient elevation between the already installed scheme and this next lowest one. This provides entry for the forklifts to get in under the entire remaining stack to remove it from the installed scheme. The same procedure then is repeated again, engaging overlapping portion 45 on the now lowest scheme in the stack to the purlin 54 of the preveiously installed scheme 43, etc.

In addition to the centering of the schemes as noted aforesaid, another advantage to this method of constructing roofing schemes and installing them in a roofing context is the fact that with a complete installation of a series of these schemes within a roofing context, and which can be accomplished by the end of a workday, quickly, no unleft panel assemblies or schemes in installed position can be damaged or flung away by winds that erupt during night hours. Thus it is another object of this invention to eliminate duplicate roofing installation that would follow on the next workday because of such wind interference.

The materials of the schemes are known in the construction and building arts, as are the pieces of equipment—forklifts, jigs, hoists, carriers, etc.—by which they are moved about and constructed. Also, suitable binders and nails are known.

INDUSTRIAL APPLICABILITY

The invention is capable of exploitation in the building and construction arts and industries, although not necessarily limited thereto.

Various changes and modifications may be made in carrying out the invention and its operation, without departing from the spirit or scope of the appended claims.

I claim:

1. A method of stacking a plurality of unitized roofing schemes each of which including a panel assembly fastened to a purlin or the like, comprising (1) positioning stacking means at a station, (2) mounting a purlin or the like to said stacking means, (3) fastening said panel assembly to said purlin or the like and thereby achieving the unitized roofing scheme to be stacked, and (4) repeating steps (2) and (3) at least once more to thereby achieve another like unitized roofing scheme in a stacked relationship to the first-mentioned scheme.

2. The method of claim 1 including the step of binding together the stacked schemes.

3. The method of claim 1 or claim 2 including the step of trnasporting each panel assembly to the station.

4. The method of claim 3 wherein said transporting step includes the step of lowering each panel assembly to the station and upon its corresponding purlin or the like mounted on said stacking means.

5. The method of claim 1 or claim 2 including the step of leveling the panel assembly prior to fastening it to the first-mentioned purlin or the like.

6. The method of claim 3 including the step of leveling the panel assembly prior to fastening it to the first-mentioned purlin or the like.

7. The method of claim 4 including the step of leveling the panel assembly prior to fastening it to the first-mentioned purlin or the like.

8. A method of installing a stack of at least two unitized roofing schemes each including a purlin or the like and a panel assembly fastened to it into a roofing section formed by at least a pair of beams or the like, comprising (1) raising the stack to above the roof line for such beams or the like, (2) orienting such stack in relation to such beams or the like, (3) settling the lowest of such schemes in such stack into a proper mounting and engaging position relative to such beams or the like, (4) removing the remaining scheme or schemes in the stack from such lowest of such schemes which now has been installed, and (5) repeating steps (3) and (4) as often as necessary with the next lowest scheme in the stack now the lowest therein in relation to the purlin or the like of the immediately previously installed scheme.

9. The method of claim 8 wherein said stack is a bound stack, the method then including the step of unbinding the bound stack of schemes prior to the settling step.

10. The method of claim 9 wherein the unbinding step precedes the step of raising the stack.

11. A method of stacking a plurality of unitized roofing schemes each of which including a panel assembly fastened to a purlin or the like, comprising (1) positioning stacking means at a station, (2) leveling a panel assembly first positioned on said stacking means and prior to its fastening to a purlin or the like to form each of said unitized roofing schemes, and (3) stacking at least two or more of said schemes on said stacking means.

12. The method of claim 11 including the step of binding together the stacked schemes.

13. The method of claim 11 or claim 12 including the step of transporting each panel assembly to the station.

14. The method of claim 13 wherein said transporting step includes lowering each panel assembly to the station and upon its corresponding purlin or the like mounted on said stacking means.

15. A method of stacking and installing a plurality of roofing schemes into a roofing section formed by at least a pair of beams or the like, each of such schemes including a purlin or the like and a panel assembly fastened to it, comprising (1) positioning stacking means at a station, (2) mounting a purlin or the like to said stacking means, (3) fastening a panel assembly to the purlin or the like, (4) mounting another purlin or the like to said stacking means, (5) fastening another panel assembly to the purlin or the like of step (4), thereby accomplishing the stacking of such plurality, (6) raising the stacked schemes to above the roof line for such beams or the like, (7) orienting the stacked schemes in relation to such beams or the like, (8) settling the lowest of such stacked schemes into a proper mounting and engaging position relative to such beams or the like, (9) removing the remaining one or more of such stacked schemes from such lowest of such schemes which now has been installed, and

(10) repeating steps (8) and (9) as often as necessary with the next lowest stacked scheme now the lowest therein in relation to the purlin or the like of the immediately previously installed scheme.

16. The method of claim 15 wherein said stack is a bound stack, the method then including the step of unbinding the bound stack of schemes prior to the settling step.

17. The method of claim 16 wherein the unbinding step precedes the step of raising the stack.

18. The method of claim 15 or claim 16 or claim 17 including the step of leveling the panel assembly first positioned on said stacking means and prior to fastening it to its purlin or the like the act of which resulting in a stacking thereof on said stacking means.

19. A method of installing a plurality of unitized roofing schemes arranged in a stack one over the other to a roofing context comprising (1) settling the lowest of such schemes in the stack into a proper mounting and engaging position relative to such roofing context, (2) fastening such lowest of such schemes in the stack to such roofing context, (3) removing the stack from the fastened lowest of such schemes thereby generating a new lowest of such schemes in such stack, and (4) repeating steps (1) and (2) as often as necessary with the next lowest of such schemes as it is generated by the fastening of the immediately previously installed lowest of the schemes in the stack.

* * * * *